US008209804B2

(12) United States Patent
Apperson et al.

(10) Patent No.: US 8,209,804 B2
(45) Date of Patent: Jul. 3, 2012

(54) CUSTOMIZABLE MATTRESS TOPPER SYSTEM

(75) Inventors: Edmund Apperson, Havertown, PA (US); Aaron Lee, Philadelphia, PA (US); Vishal Malhotra, Malvern, PA (US); Beat B. Niederoest, Medford Lakes, NJ (US)

(73) Assignee: Foamex Innovations Operating Company, Media, PA (US)

( * ) Notice: Subject to any disclaimer, the term of this patent is extended or adjusted under 35 U.S.C. 154(b) by 1479 days.

(21) Appl. No.: 11/163,690

(22) Filed: Oct. 27, 2005
(Under 37 CFR 1.47)

(65) Prior Publication Data

US 2006/0260060 A1 Nov. 23, 2006

Related U.S. Application Data

(63) Continuation-in-part of application No. 11/132,868, filed on May 19, 2005, now abandoned.

(51) Int. Cl.
*A47C 27/15* (2006.01)

(52) U.S. Cl. ..... 5/691; 5/740; 5/728

(58) Field of Classification Search ..... 5/691, 722, 5/727–728, 737, 740
See application file for complete search history.

(56) References Cited

U.S. PATENT DOCUMENTS

| | | | | |
|---|---|---|---|---|
| 3,133,853 | A | 5/1964 | Knox | |
| 3,197,357 | A | 7/1965 | Schulpen | |
| 4,276,666 | A * | 7/1981 | Yamada | 5/736 |
| 4,673,452 | A | 6/1987 | Awdhan | |
| 5,022,111 | A | 6/1991 | Fenner, Sr. | |
| 5,031,261 | A | 7/1991 | Fenner, Sr. | |
| 5,136,741 | A | 8/1992 | Balonick et al. | |
| 5,230,947 | A | 7/1993 | Ou | |
| 5,513,402 | A * | 5/1996 | Schwartz | 5/691 |
| 5,636,397 | A | 6/1997 | Boyd et al. | |
| 6,159,574 | A | 12/2000 | Landvik et al. | |
| 6,192,538 | B1 | 2/2001 | Fogel | |
| 6,481,033 | B2 | 11/2002 | Fogel | |
| 6,541,094 | B1 * | 4/2003 | Landvik et al. | 428/71 |
| 6,596,387 | B2 | 7/2003 | Ogle | |
| 6,602,579 | B2 | 8/2003 | Landvik | |
| 6,668,409 | B1 | 12/2003 | Blumer | |
| 2003/0150061 | A1 | 8/2003 | Farley | |

* cited by examiner

*Primary Examiner* — Fredrick Conley
(74) *Attorney, Agent, or Firm* — Connolly Bove Lodge & Hutz LLP

(57) ABSTRACT

A customizable mattress topper system includes a first mattress topper of viscoelastic foam with a shaped top surface and a second foam mattress topper. The viscoelastic foam topper has a higher density than the second topper. The first mattress topper and second mattress topper are packaged and sold together as a system. The first mattress topper may be placed over the second mattress topper, or vice versa, and in various orientations over a bedding mattress as desired by a consumer to customize the level of cushioning support.

14 Claims, 2 Drawing Sheets

12
20
16
18
A 22
14
24
26

12
14

12
14

12
14
B 14
12

14
12
30

14
12

14
12
C

14

CUSTOMIZABLE MATTRESS TOPPER SYSTEM

CROSS REFERENCE TO RELATED APPLICATIONS

This application is a continuation-in-part of U.S. patent application Ser. No. 11/132,686, filed May 19, 2005, still pending.

BACKGROUND OF THE INVENTION

1. Field of the Invention

This invention relates to a mattress topper system wherein at least one surface shaped topper and at least one other topper or pad are packaged together for customized installation over a sleeping mattress by a consumer. The surface shaped topper and at least one other topper may be used singly or together and with the shaped surface upright or inverted to vary support characteristics of the topper system.

2. Description of the Related Art

Sleep mattresses of varying construction to produce varying body-support from soft to firm are known. Consumers may alter the firmness or may increase air circulation by installing a mattress topper over the top surface of a mattress. Mattress toppers frequently are formed of polyurethane foams with a shaped top surface and a planar bottom surface. The shaped top surface may be formed by cutting and removing portions of foam from the top surface. Convolute cutting is one known method to form peaks and valleys in the top surface of a slab of polyurethane foam.

Whether as a result of injury or simply due to changing preference, consumers may wish to alter the cushioning support from a bedding mattress without investing in a new mattress. When installed over a mattress, a mattress topper provides additional cushioning support.

Viscoelastic foams can be used to make mattress toppers. Viscoelastic or memory foams exhibit a slower recovery from compression as compared to other foams, such as conventional polyurethane foams. Viscoelastic foams conform to a body reclining thereon, and offer some consumers greater comfort and heat retention as compared to conventional foams.

Mattresses that combine multiple layers of support cushions of various constructions have been produced. U.S. Pat. No. 6,159,574 shows a laminated support having an upper layer of viscoelastic foam, a middle layer of a viscoelastic foam of increased hardness and a bottom layer of resilient polyurethane foam. This laminated support is formed by adhering the layers together. The laminated support thus remains in the preferred configuration, and is delivered to a consumer within a fabric casing thus forming a mattress. See also U.S. Pat. No. 4,276,666 showing a mattress formed of two polyurethane foam layers with convolute top surfaces enveloped in a casing.

In U.S. Pat. No. 6,602,579, a cushion is shown as a combination of an underlying layer of polyurethane foam with a shaped upper surface and an overlying layer of viscoelastic foam. The viscoelastic foam has planar top and bottom surfaces, and is adhered to the tops of the projections of the polyurethane foam layer to form the cushion. This cushion thus remains in one preferred configuration.

These patents indicate that support characteristics can be varied by combining a viscoelastic foam with a conventional foam in a mattress construction. Heretofore, it has not been known to give a consumer a choice of support characteristic by packaging together a customizable mattress topper system that includes (a) a viscoelastic foam topper with at least one shaped support surface and (b) a polyurethane foam topper, where such system may be arranged over an existing mattress in multiple configurations.

SUMMARY OF THE INVENTION

In a first aspect of the invention, a mattress topper system includes a first foam layer of viscoelastic foam and a second foam layer. Preferably, each foam layer has a top surface and a bottom surface wherein said top surface is shaped. The second foam layer has a density less than the first foam layer. The second foam layer may be a conventional polyurethane foam or may be a viscoelastic foam. Preferably the two foam layers forming the mattress topper system are packaged together for delivery to a consumer. Such system may include consumer instructions for varying the support level by placing the first foam layer and the second foam layer in different orientations over a mattress. The hardness of the mattress topper system may be varied from an $IFD_{25}$ of about 4 to an $IFD_{25}$ of about 25.

The shaped top surface of the first foam layer may have one or more projections, and the shaped top surface of the second foam layer may have one or more depressions or troughs. Preferably, each projection from the first foam layer is nestable within at least one of the depressions in the shaped surface of the second foam layer. Alternatively, the shaped top surfaces of each foam layer are not nestable.

A second aspect of the invention is a method for varying cushioning support level of a mattress with a mattress topper system. In such method, a first foam layer of viscoelastic foam and a second foam layer are provided. Each foam layer preferably has a top surface and a bottom surface wherein said top surface is shaped. The second foam layer has a density less than said first foam layer. Preferably, the first and second foam layers are packaged together for delivery to a consumer. Instructions are provided to instruct a consumer to vary cushioning support level by positioning the first foam layer and second foam layer over a mattress surface by specifying alternate foam layer configurations to increase cushioning support level. The hardness of the mattress topper system may be varied from an $IFD_{25}$ of about 4 to an $IFD_{25}$ of about 25.

The second foam layer may be conventional polyurethane foam or viscoelastic foam. The shaped top surface of the first foam layer may have one or more projections, and the shaped top surface of the second foam layer may have one or more depressions or troughs. Preferably, each projection from the first foam layer is nestable within at least one of the depressions in the shaped surface of the second foam layer. Alternatively, the shaped top surfaces of each foam layer are not nestable.

Other aspects of the invention will be clear from the following description.

DESCRIPTION OF THE PREFERRED EMBODIMENTS

Figures 1, 2, 3, 4, 5, 6, 7, 8, 9, 10:
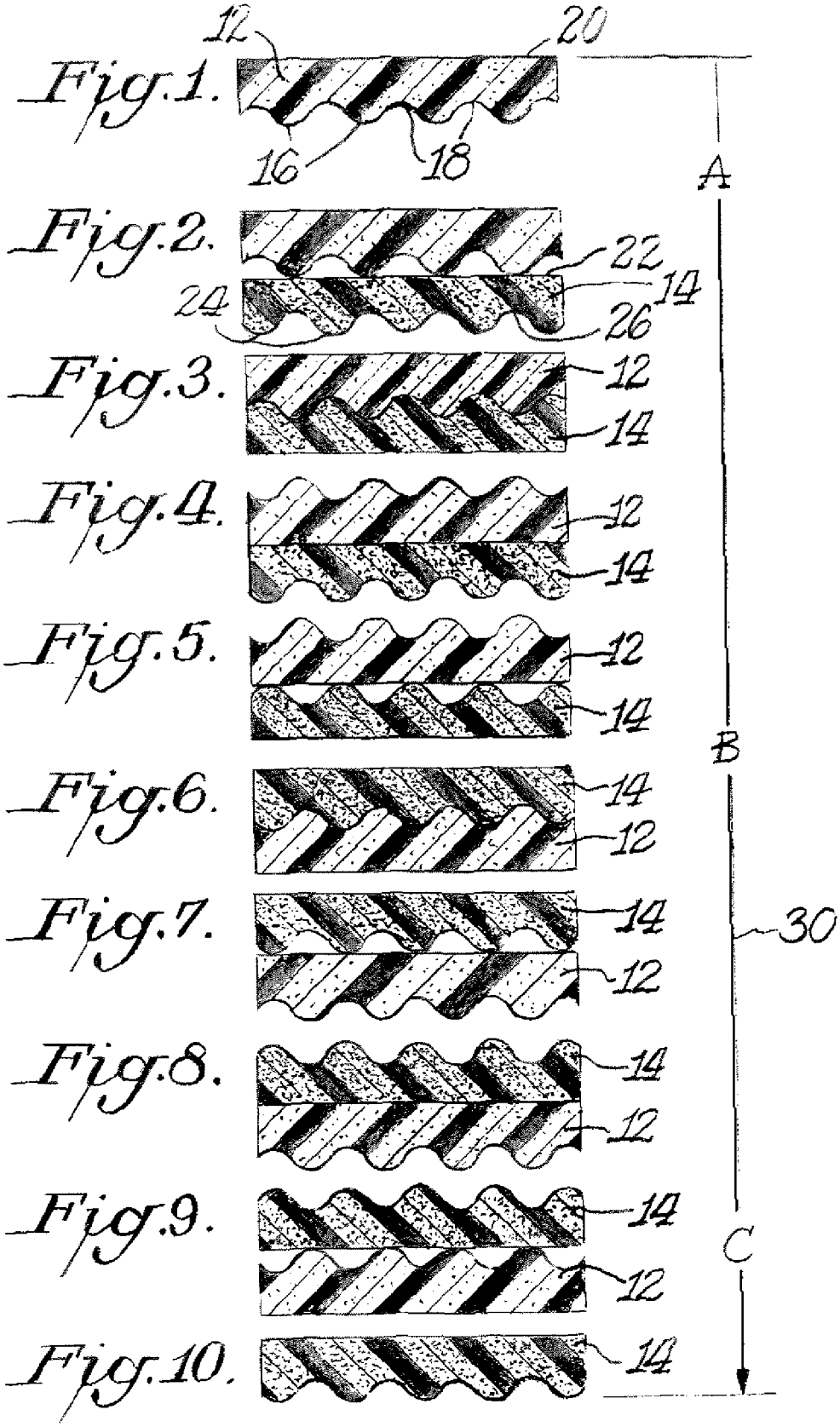
FIG. 1 is a cross-sectional view in side elevation of a first mattress topper of viscoelastic foam with a shaped upper surface that has been inverted such that projections from the shaped upper surface are oriented downwardly.
FIG. 2 is a cross-sectional view in side elevation of a topper system comprising the first mattress topper of FIG. 1 oriented with shaped upper surface facing downward and a second mattress topper of polyurethane foam with a shaped upper surface oriented with the shaped upper surface facing downward.
FIG. 3 is a cross-sectional view in side elevation of the topper system of FIG. 2, wherein the shaped upper surface of the first mattress topper nests with the shaped upper surface of the second mattress topper.
FIG. 4 is a cross-sectional view in side elevation of the topper system of FIG. 2, wherein the shaped upper surface of the first mattress topper and the shaped upper surface of the second mattress topper are disposed oppositely.
FIG. 5 is a cross-sectional view in side elevation of the topper system of FIG. 2, wherein the shaped upper surface of the first mattress topper and the shaped upper surface of the second mattress topper each face upwardly.
FIG. 6 is a cross-sectional view in side elevation of the topper system of FIG. 2, wherein the first mattress topper is positioned below the second mattress topper and the shaped upper surface of the second mattress topper nests with the shaped upper surface of the first mattress topper.
FIG. 7 is a cross-sectional view in side elevation of the topper system of FIG. 2, wherein the shaped upper surface of the first mattress topper and the shaped upper surface of the second mattress topper each face downwardly, with the first mattress topper positioned below the second mattress topper.
FIG. 8 is a cross-sectional view in side elevation of the topper system of FIG. 2, wherein the shaped upper surface of the first mattress topper and the shaped upper surface of the second mattress topper are disposed oppositely, with the first mattress topper positioned below the second mattress topper.
FIG. 9 is a cross-sectional view in side elevation of the topper system of FIG. 2, wherein the shaped upper surface of the first mattress topper and the shaped upper surface of the second mattress topper each face upwardly, with the first mattress topper positioned below the second mattress topper.
FIG. 10 is a cross-sectional view in side elevation of the second mattress topper oriented with the shaped upper surface facing downward.

Referring first to FIG. 1, a first mattress topper 12 is formed of a viscoelastic foam. The topper 12 has a shaped upper surface having projections 16 separated by valleys 18, and a planar bottom surface 20. As shown in FIG. 1, the topper 12 is oriented with the shaped upper surface facing downwardly. Alternatively, the shaped upper surface may face upwardly such that the projections 16 and valleys 18 are directed upwardly. The topper 12 provides a first level of cushioning support with the projections 16 facing upwardly toward the body reclining thereon. The topper 12 provides a second level of cushioning support that is somewhat higher than the first level of cushioning support when the projections 16 face downwardly and away from the body reclining thereon (as shown in FIG. 1).

Referring next to FIG. 2, a combination of the first mattress topper 12 with a second mattress topper 14 is shown. The second mattress topper is formed of a polyurethane foam, rather than a viscoelastic foam. In this combination, the first mattress topper 12 (of viscoelastic foam) is oriented so that the projections 16 face downwardly and are in contact with a planar bottom surface 22 of the second mattress topper 14 (of polyurethane foam). The second mattress topper 14 is oriented so that the projections 24 extending from the shaped upper surface of said topper 14 face downwardly. The projections 24 of the shaped upper surface are separated by valleys 26. The combination of the first mattress topper 12 and second mattress topper 14 as shown in FIG. 2 provides a third level of cushioning support that is greater than the first or second levels of cushioning support achieved by solely using the first mattress topper 12 of viscoelastic foam.

In FIG. 3, the first mattress topper 12 is nested with the second mattress topper 14, such that the projections 16 from the first mattress topper 12 mate with the valleys 26 of the second mattress topper 14. In this configuration, the first mattress topper 12 is provided as the top layer, with its projections 16 facing downwardly, and the second mattress topper 14 is provided as the bottom layer, with its projections 24 facing upwardly. This combination of the first mattress topper 12 and the second mattress topper 14 as shown in FIG. 3 provides a fourth level of cushioning support that is greater than the third level of cushioning support achieved by the combination shown in FIG. 2.

In FIG. 4, the first mattress topper 12 and second mattress topper 14 have their planar bottom surfaces in contact, with the projections 16 of the first topper 12 facing upwardly and the projections 24 of the second topper 14 facing downwardly. This combination as shown in FIG. 4 provides a fifth level of cushioning support that is different from the first, second, third and fourth levels of cushioning support.

Alternatively, the first mattress topper 12 may be positioned over the second mattress topper 14 wherein the projections 16, 24 of both toppers face upwardly. As shown in FIG. 5, the first mattress topper 12 is over the second mattress topper 14. This combination as shown in FIG. 5 provides a sixth level of cushioning support that is different from the first, second, third, fourth and fifth levels of cushioning support.

In the embodiments shown in FIGS. 1 to 5, the first mattress topper 12 (of viscoelastic foam) is either the sole topper or comprises the top layer of the combination. In the embodiments shown in FIGS. 6 to 10, the second mattress topper 14 (of polyurethane foam) is either the sole topper or comprises the top layer of the combination. The level of cushioning support achieved by the mattress toppers continues to increase with the combinations shown in FIGS. 6 to 10. The arrow 30 points in the direction of increasing hardness or increasing support, where A is less than B and B is less than C.

FIG. 6 shows the first mattress topper 12 nested with the second mattress topper 14, with the second mattress topper 14 positioned over the first mattress topper 12. FIG. 7 shows the first mattress topper 12 with projections 16 pointed downwardly, and the second mattress topper 14 over the first topper 12 and with projections 24 pointed downwardly and contacting the planar 20 surface of the first topper 12. FIG. 8 shows the first and second toppers 12, 14 oriented with planar surfaces 20, 22 in contact with one another, and with the second topper 14 over the first topper 12. FIG. 9 shows the first mattress topper 12 with projections 16 pointed upwardly, and the second mattress topper 14 over the first topper 12 and with projections 24 pointed upwardly. The projections 16 contact the planar surface 22 of the second topper 14.

FIG. 10 shows the second topper 14 oriented with projections 24 facing downwardly. The second mattress topper 14 may be used solely with projections 24 facing downwardly as is shown, or upwardly (not shown).

Preferably, the viscoelastic foam comprising the first mattress topper 12 has a density in the range of 2.0 to 6.0 pounds per cubic foot ("pcf"), most preferably from 2.5 to 5.0 pcf. Such viscoelastic foam also preferably has a hardness or an internal force deflection ($IFD_{25}$) in the range of 4 to 8. Preferably, the polyurethane foam comprising the second mattress topper 14 is a polyether polyurethane foam having a density in the range of from 1.0 to 3.0 pcf, most preferably from 1.3 to 1.9 pcf. Such polyurethane foam also preferably has a hardness or an internal force deflection ($IFD_{25}$) in the range of 12 to 25. In the preferred embodiment, the toppers have equivalent thicknesses of 2 to 4 inches, with a cut depth of 0.5 to 1 inches.

The first mattress topper 12 and the second mattress topper 14 are packaged together and sold to consumers as a combination or system for customizing the level of cushioning support. Instructions are included in or on the packaging to describe the various combinations of toppers and the varying support level resulting from such combinations. Thus, a consumer could select one of the combinations of toppers as shown in FIGS. 1 to 10 to provide a desired level of cushioning support from lower (such as A) to higher (such as B or C). With the preferred viscoelastic foam and polyurethane foam with densities and thicknesses in the ranges recited above, A represents a hardness in the range of $IFD_{25}$ of about 4 to about 6 and B represents a hardness in the range of $IFD_{25}$ of about 7 to about 10 and C represents a hardness in the range of $IFD_{25}$ of about 11 to about 25.

As an alternative, both the first mattress topper and the second mattress topper may be constructed of viscoelastic foams, wherein such foams have varying density and/or varying recovery properties.

Figure 11:
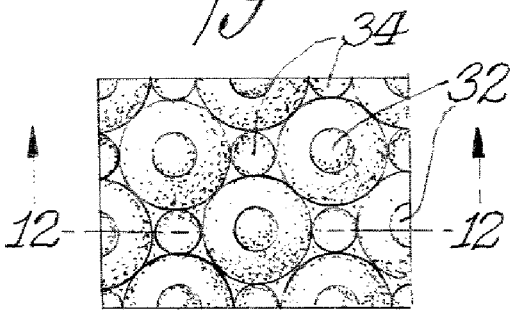
FIG. 11 is a partial top plan view of a mattress topper showing one embodiment of a shaped upper surface having convolute peaks and valleys.
Figure 12:
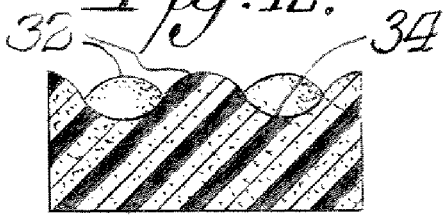
FIG. 12 is a cross-sectional view in side elevation taken along line 12-12 of FIG. 11.

One embodiment of a shaped surface for mattress toppers for use in the system of the present invention is shown in FIGS. 11 and 12. A convolute structure has a series of peaks 32 separated by valleys 34. The height of the peaks 32 substantially matches the depth of the valleys 34 so that the peaks will nest within the valleys. Peak height may vary, but for a mattress topper with a thickness of from 1.5 to 2.0 inches, the peaks generally extend from 0.5 to 1.0 inch.

Figure 13:
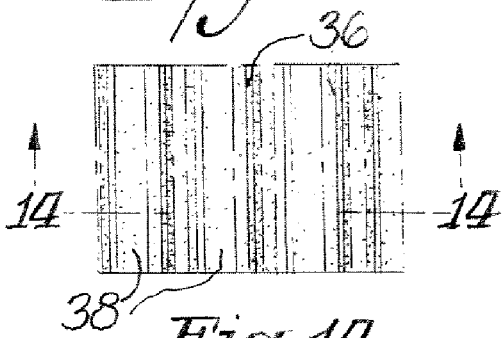
FIG. 13 is a partial top plan view of a mattress topper showing another embodiment of a shaped upper surface having upstanding ridges.
Figure 14:
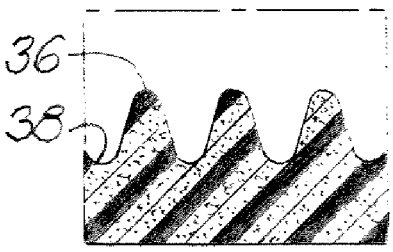
FIG. 14 is a cross-sectional view in side elevation taken along line 14-14 of FIG. 13.

Another embodiment of a shaped surface for mattress toppers for use in the system of the present invention is shown in FIGS. 13 and 14. In this embodiment, elongated ridges 36 are separated by elongated troughs 38 forming rows along either the length or the width of the topper. The height of the ridges 36 substantially matches the depth of the troughs 38 so that the ridges 36 will nest within the troughs 38.

Figure 15:
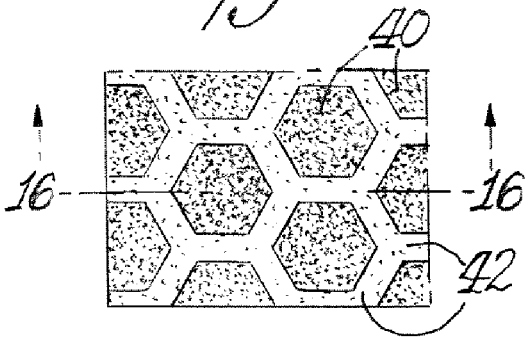
FIG. 15 is a partial top plan view of a mattress topper showing yet another embodiment of a shaped upper surfacing having upstanding hexagonal projections.
Figure 16:
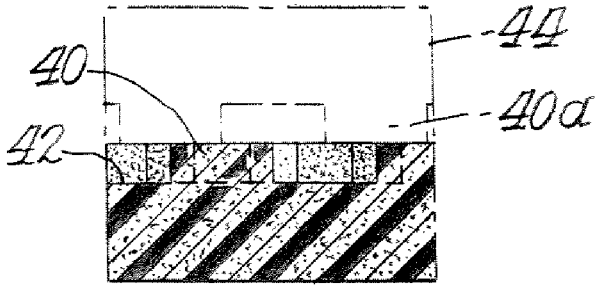
FIG. 16 is a cross-sectional view in side elevation taken along line 16-16 of FIG. 15, and further including in phantom outline an inverted second mattress topper.

FIGS. 15 and 16 show yet another embodiment of a shaped surface for mattress toppers for use in the system of the present invention. Hexagonal projections 40 are separated by troughs 42. As shown in FIG. 16, the projections 40 do not nest within the troughs 42. Thus, the projections 40*a* from a second topper 44 shown in phantom outline contact the top surfaces of projections 40 of the first topper.

The shaped surfaces of the mattress toppers used in the system of the present invention may be formed in various ways known to persons of skill in the art of foam fabrication, including convolute cutting, surface modification as described in U.S. Pat. No. 5,534,208, platform cutting as described in U.S. Pat. No. 6,142,053, hot wire cutting, etc. Various configurations of shaped surfaces may be used, including surfaces that have projections that nest within depressions or valleys or troughs within another surface, and surfaces that have regular or irregular shaped projections that do not nest.

The mattress toppers generally will have outer dimensions that will fit over standard bedding mattresses. Thicknesses of the toppers will vary, but generally may be in the range of 1.5 to 4 inches, most often about 2 inches. Depth of cut of projections or patterns within the topper surface may vary, but generally may be in the range of 0.5 to 1.5 inches.

Polyurethane foam for one of the toppers may be produced according to methods known to persons skilled in the art. In general, polyurethane foams are prepared by reacting a polyol with a polyisocyanate in the presence of a catalyst, a blowing agent, one or more foam stabilizers or surfactants and other foaming aids. The gas generated during polymerization causes foaming of the reaction mixture to form a cellular or foam structure. In the present invention, the polyol preferably is a polyether polyol, although polyether graft polyols and ester polyols may also be used, and the polyether polyols also may be mixed with the polyether graft polyols or ester polyols.

Polyether polyols used to prepare flexible polyurethane foams typically have molecular weights between 500 and 8000 (i.e., number average molecular weight measured by gel permeation chromatography). One example of such polyether polyol is Voranol 3010 from Dow Chemical (having a reported molecular weight of about 3000±100, which is determined by a formula which corresponds well to number average molecular weight measured by gel permeation chromatography), and a hydroxyl number ("OH") of 56 mg KOH/g with an EO content of 8.5%. Another example is Pluracol 1103 from BASF (having a reported molecular weight measured of about 3100 which is determined by a formula which corresponds well to number average molecular weight measured by gel permeation chromatography).

The term polyether polyol includes linear and branched polyether (having ether linkages) and containing at least two hydroxyl groups, and includes polyoxypropylene polyether polyol or mixed poly(oxyethylene/oxypropylene) polyether polyol. Preferred polyethers are the polyoxyalkylene polyols, particularly the linear and branched poly(oxyethylene) glycols, poly(oxypropylene) glycols and their co-polymers.

Graft or modified polyether polyols are those polyether polyols having a polymer of ethylenically unsaturated monomers dispersed therein. Representative modified polyether polyols include polyoxypropylene polyether polyol into which is dispersed poly(styrene acrylonitrile) or polyurea, and poly(oxyethylene/oxypropylene) polyether polyols into which is dispersed poly (styrene acrylonitrile) or polyurea. Graft or modified polyether polyols contain dispersed polymeric solids. The solids increase hardness and mechanical strength of the resultant foam. Examples of graft polyols are Arcol HS-100 from Bayer AG and Voranol 3943 from Dow. Modified polyether polyols are commercially available from several companies, including Arco, now Bayer (supplied as "Polymer Polyol" or "PHD Polyol"), BASF (supplied as "Graft Polyol"), and Dow Chemical (supplied as "Co-polymer Polyol). Bayer ("Polymer Polyol"), BASF, and Dow disperse poly(styrene acrylonitrile) into the polyol, whereas Bayer ("PHD Polyol") disperses polyurea therein.

Ester polyols include polymeric polyols containing a number of ester groups in the main or side chains. Ester polyols are commercially available from Witco Chemical (supplied as "Fomrez 50") and from Inolex (supplied as "1102-50"). 1102-50 is a 50 hydroxyl triol ester polyol with a molecular weight of about 3000.

The polyol component may comprise a mixture of a polyether graft polyol with an ester polyol, or a mixture of a polyether graft polyol with a polyether polyol, or a mixture of an ester polyol with a polyether polyol.

The "hydroxyl number" for a polyol is a measure of the amount of reactive hydroxyl groups available for reaction. The value is reported as the number of milligrams of potassium hydroxide equivalent to the hydroxyl groups found in one gram of the sample, and ranges generally from 20 to 150. "Functionality" of a polyol is defined as the average number of hydroxyl group sites per molecule.

The term "polyisocyanate" refers particularly to isocyanates that have previously been suggested for use in preparing polyurethane foams. "Polyisocyanates" include di- and polyisocyanates and prepolymers of polyols and polyisocyanates having excess isocyanate groups available to react with additional polyol. The amount of polyisocyanate employed is frequently expressed by the term "index", which refers to the actual amount of isocyanate required for reaction with all of the active hydrogen-containing compounds present in the reaction mixture multiplied by 100. For most foam applications, the isocyanate index is in the range of between about 60 to 140.

Polyurethane foams are prepared using any suitable organic polyisocyanates well known in the art including, for example, hexamethylene diisocyanate, phenylene diisocyanate, toluene diisocyanate (TDI) and 4,4'-diphenylmethane diisocyanate (MDI). The methylene diisocyanates suitable for use are diphenyl methane diisocyanate and polymethylene polyphenyl isocyanate blends (sometimes referred to as "MDI" or "polymeric MDI"). The MDI blends can contain diphenylmethane 4, 4'diisocyanate, as well as 2, 2' and 2, 4' isomers and higher molecular weight oligomers and have an isocyanate functionality of from about 2.1 to 2.7, preferably from about 2.1 to 2.5. Preferably, the isocyanate is selected from a commercial mixture of 2,4- and 2,6-toluene diisocyanate. A well-known commercial toluene diisocyanate is TD80, a blend of 80% 2, 4 toluene diisocyanate and 20% 2, 6 toluene diisocyanate. Polyisocyanates are typically used at a level of between 20 and 90 parts by weight per 100 parts of polyol, depending upon the polyol OH content and water content of the formulation.

One or more surfactants are also employed in the foam-forming composition. The surfactants lower the bulk surface tension, promote nucleation of bubbles, stabilize the rising cellular structure, emulsify incompatible ingredients, and may have some effect on the hydrophilicity of the resulting foam. The surfactants typically used in polyurethane foam applications are polysiloxane-polyoxyalkylene copolymers, which are generally used at levels between about 0.5 and 3 parts by weight per 100 parts polyol. Surfactants, which for example may be organic or silicone based, such as FOMREZ M66-86A (Witco) and L532 (OSi Specialties) may be used to stabilize the cell structure, to act as emulsifiers and to assist in mixing. A cell opening silicone surfactant may be included in an amount from 1.5 to 2.5 parts by weight per 100 parts polyol.

Catalysts are used to control the relative rates of water-polyisocyanate (gas-forming or blowing) and polyol-polyisocyanate (gelling) reactions. The catalyst may be a single component, or in most cases a mixture of two or more compounds. Preferred catalysts for polyurethane foam production are organotin salts and tertiary amines. The amine catalysts are known to have a greater effect on the water-polyisocyanate reaction, whereas the organotin catalysts are known to have a greater effect on the polyol-polyisocyanate reaction. Total catalyst levels generally vary from 0 to 5.0 parts by weight per 100 parts polyol. The amount of catalyst used depends upon the formulation employed and the type of catalyst, as known to those skilled in the art. Although various catalysts may be used, generally the following ranges of catalyst amounts are satisfactory: amine catalyst from 0.5 to 2.0 parts per 100 parts polyol; and organotin catalyst from 0 to 0.7 parts per 100 parts polyol.

A blowing agent may be included in the foam-forming composition. The most typical blowing agent is water that may be added in amounts from 1.5 to 5.0 parts per 100 parts polyol. Alternative blowing agents are liquid carbon dioxide, volatile organic compounds, such as pentane and acetone, and chlorinated compounds, such as methylene chloride, HFC's, HCFC's and CFC's.

Optionally, other additives may be incorporated into the foam-forming composition. The optional additives include, but are not limited to, antimicrobial compounds, stabilizers, extenders, dyes, pigments, crosslinking additives, fragrances, detergents and anti-static agents. Such additives should not have a detrimental effect on the properties of the final polyurethane foam. For mattress topper or cushion applications, preferably an antimicrobial compound is added in an amount from 0.5 to 1.5 parts per 100 parts polyol.

The polyurethane foams forming the mattress toppers of the present invention may be prepared using the one shot or the pre-polymer methods that are well known to the art, and in which hydroxyl containing ingredients (polyols) and polyisocyanates are combined in the presence of catalysts, blowing agents, foam stabilizers, and optionally other additives. Polyester based polyurethanes, polyether based polyurethanes, copolymer polyol based polyurethanes and mixtures of these substances may be used in making polyurethane foams. Once the foam-forming ingredients are mixed together, it is known that the foam may be formed under either elevated or reduced controlled pressure conditions.

Polyurethane foams with varying density and hardness may be formed. Hardness is typically measured as IFD ("indentation force deflection"). Specifically, $IFD_{25}$ is the force required to compress the foam to 25% of its original thickness or height using the test method set out in ASTM D-3574. Tensile strength, tear strength, compression set, air permeability, fatigue resistance, support factor, and energy absorbing characteristics may also be varied, as can many other properties. Specific polyurethane foam characteristics depend upon the selection of the starting materials, the foaming process and conditions, and sometimes on the subsequent processing.

Viscoelastic polyurethane foams are characterized by high vibration damping, body conformance and slow recovery from compression. Viscoelastic foams have gained popularity for bedding applications because such foams are advertised as reducing pressure points, which are believed to cause tossing and turning during sleep.

Viscoelastic foams exhibit slower recovery when a compression force is released than do other resilient polyurethane foams. For example, after being released from compression, a resilient polyurethane foam at room temperature, atmospheric condition generally recovers to its full uncompressed height or thickness in one second or less. By contrast, a viscoelastic foam of the same density and thickness, and at the same room temperature condition, will take significantly longer to recover, even from two to sixty seconds. The recovery time of viscoelastic foams is sensitive to temperature changes within a range close to standard room temperature.

Slow recovery foams also exhibit ball rebound values of generally less than about 20% as compared to about 40% or more for other foams.

A precise definition of a viscoelastic foam is derived by a dynamic mechanical analysis to measure the glass transition temperature (Tg) of the foam. Nonviscoelastic resilient polyurethane foams, based on a 3000 molecular weight polyether triol, generally have glass transition temperatures below −30° C., and possibly even below −50° C. By contrast, viscoelastic polyurethane foams have glass transition temperatures above −20° C. If the foam has a glass transition temperature above 0° C., or closer to room temperature (e.g. room temperature=about +20° C.), the foam will manifest more viscoelastic character (i.e., slower recovery from compression) if all other parameters are held constant.

All or almost all polyurethane foams undergo a transition from a rigid glass-like state to a soft rubber-like state. Over that transition, the foam is viscoelastic. For a typical slabstock polyurethane foam, the viscoelastic transition occurs at about −50° C., which is termed its glass transition temperature. Such a low glass transition temperature limits the usefulness of such foams for room temperature applications.

Unfortunately, there is no ASTM or other standardized test for measuring foam viscoelasticity. One common way to quantify viscoelasticity is to measure the visco recovery time. In that measurement, a pre-determined load is applied to the foam for a fixed amount of time, typically resulting in a significant indentation. After the load is removed, the time it takes the foam to recover to its original height or to a predetermined height is measured. A longer recovery time indicates a higher degree of viscoelasticity. The load size and shape and the foam shape geometry in such tests have not been standardized. The viscoelasticity measurement is further complicated because the viscoelasticity property does not remain constant, but tends to deteriorate over time in low-index foams. In general, the lower density products have a lower initial viscoelasticity and poorer retention of viscoelasticity over time.

To make a viscoelastic foam, it is often desirable to use a so-called "viscoelastic polyol". The viscoelastic polyols are characterized by high OH numbers of above 120 and tend to produce shorter chain polyurethane blocks with a glass transition temperature closer to room temperature. Examples of the higher-OH polyols are U-1000 from Bayer and G30-167 from Huntsman, both of which contain no EO. See e.g., U.S. Pat. No. 6,734,220 for one method for making viscoelastic foams.

The viscoelastic recovery time may be measured by applying a load to compress a foam sample to 25% of its original height. For example, the original dimensions of the sample might be 4"×4"×1", and the foam may be held at this 75% compression for five (5) seconds. After the load is removed, the time it takes the foam sample recover to 90% of its original height (10% compression) can be measured. A longer recovery time indicates a higher degree of viscoelasticity. The height recovery target of 90% is arbitrarily chosen since the full height recovery may take an impractically long time for viscoelastic foams. Foams with recovery times of 2 seconds or more are sufficiently viscoelastic for use within the present invention. Foams with faster recovery times may also be suitable depending upon the circumstances.

Various alternatives may be made to the present invention without departing from the scope thereof. The invention is further illustrated by, but not limited to, the following examples.

EXAMPLES

Viscoelastic foams were prepared in commercial variable pressure foaming equipment according to the processing conditions described in U.S. Pat. No. 6,734,220. The polyols, water, surfactants, catalysts and other additives were introduced to mixing head in a separate stream from the isocyanate. Once mixed together, the foaming mixture was introduced into the bottom of a trough and allowed to rise upwardly within the trough and pour onto flow plates leading to a conveyer. The pressure within the process chamber was controlled at above atmospheric pressure.

The polyurethane foams were prepared in conventional slab stock foaming equipment. The water, isocyanate, polyols, surfactants, catalysts and other additives were poured from the fixed mixing head onto a moving conveyor and allowed to rise freely at atmospheric pressure.

IFD or "indentation force deflection" was determined in accord with a procedure similar to ASTM D 3574. In this case, for $IFD_{25}$ foam was compressed by 25% of its original height and the force was reported after one minute. The foam samples were cut to a size 15"×15"×4" prior to testing.

Table 1 below sets out the formulations for the viscoelastic foam and the polyurethane foam used to make the toppers in the examples. All parts are identified as parts by weight per 100 parts polyol.

TABLE 1

| Component | Viscoelastic | Polyurethane |
|---|---|---|
| Polyol 3943 | 22.0 | — |
| Polyol G30-167 | 78.0 | — |
| Polyol F3136 | — | 99.8 |
| TDI 80/20 | 34.0 | 49.1 |
| Water (total) | 1.93 | 3.93 |
| Amine A-1 | 0.19 | 0.02 |
| Amine TD 33A | 0.20 | 0.32 |
| Amine DEA-LFG-85 | 0.50 | — |
| Silicone L618 | 0.40 | 1.10 |
| Tin K-29 | 0.04 | 0.27 |
| Index | 0.85 | 1.06 |

The viscoelastic foam had a density of 3.0 pcf and an $IFD_{25}$ of 10. It was cut to a pad having a thickness of about 2 inches. This pad was then contour cut by a surface modification technique to form a mattress topper with diamond-shaped projections separated by troughs. The diamond-shaped projections had flat upper faces. The depth of the troughs was 1 inch.

The polyurethane foam had a density of 1.6 pcf and an $IFD_{25}$ of 30. It was cut to a pad having a thickness of about 2 inches. This pad was then contour cut by a surface modification technique to form a mattress topper with diamond-shaped projections separated by troughs. The diamond-shaped projections had flat upper faces. The depth of the troughs was 1 inch. The diamond projections of the polyurethane foam topper mated within the troughs of the viscoelastic foam topper.

The hardness ($IFD_{25}$ and $IFD_{65}$) were then measured for each topper in various configurations singly and in combination with the other topper. In some cases, a combination of two toppers of the same foam was tested. The results of these hardness measurements is set out in Table 2 below. SAG Factor is the ratio of $IFD_{65}$ to $IFD_{25}$ and can be used as one indicator of cushion comfort and support. For the material entries, the first abbreviation represents the upper topper and the second abbreviation represents the lower topper (e.g., VE/PU indicates that the upper topper was viscoelastic foam and the lower topper was polyurethane foam). "Tips up" means both toppers were oriented with projections facing upward. "Tips out" means the upper topper had projections facing upward and the lower topper had projections facing downward. "Tips down" means both toppers were oriented with projections facing downward. "Tips in" means the projections from each topper were in contact but were not interlocked.

TABLE 2

| Example | Material | Projection Tip Orientation | $IFD_{25}$ | $IFD_{65}$ | SAG |
|---|---|---|---|---|---|
| 1 | VE/VE | tips up | 5.68 | 19.42 | 3.42 |
| 2 | VE/VE | tips out | 5.99 | 18.65 | 3.11 |
| 3 | VE/VE | tips down | 6.23 | 18.91 | 3.03 |
| 4 | VE/VE | tips in, not interlocked | 6.26 | 19.97 | 3.19 |
| 5 | VE/PU | tips down | 7.45 | 29.65 | 3.98 |
| 6 | VE/PU | tips up | 7.46 | 29.75 | 3.99 |
| 7 | VE/PU | tips in, not interlocked | 8.30 | 29.00 | 3.50 |
| 8 | VE/PU | tips out | 8.91 | 28.47 | 3.20 |
| 9 | PU/VE | tips up | 9.87 | 28.29 | 2.87 |
| 10 | PU/VE | tips out | 10.06 | 26.85 | 2.67 |
| 11 | VE/VE | interlocking | 10.40 | 26.75 | 2.57 |
| 12 | PU/VE | tips down | 10.65 | 27.36 | 2.57 |
| 13 | PU/VE | tips in, not interlocked | 11.09 | 28.78 | 2.59 |
| 14 | VE/PU | interlocking | 13.11 | 35.10 | 2.68 |
| 15 | PU/PU | tips up | 13.86 | 37.18 | 2.68 |
| 16 | PU/PU | tips up | 14.53 | 38.20 | 2.63 |
| 17 | PU/PU | tips out | 15.01 | 35.35 | 2.36 |
| 18 | PU/VE | interlocking | 15.36 | 33.41 | 2.18 |
| 19 | PU/PU | tips in, not interlocking | 16.08 | 37.81 | 2.35 |
| 20 | PU/PU | tips down | 16.28 | 36.96 | 2.27 |
| 21 | PU/PU | interlocking | 20.32 | 41.89 | 2.06 |
| 22 | PU/PU | interlocking | 21.66 | 43.93 | 2.03 |
| 23 | VE | tips up | 4.84 | 15.56 | 3.22 |
| 24 | VE | tips down | 5.63 | 15.18 | 2.70 |
| 25 | PU | tips up | 12.33 | 28.22 | 2.29 |
| 26 | PU | tips down | 14.11 | 27.94 | 1.98 |

Other embodiments of the invention will be apparent to those skilled in the art from a reading of the specification and practice of the invention disclosed herein. Therefore, the specification and examples are to be considered as exemplary, and the scope and spirit of the invention shall be indicated by the following claims.

What is claimed as new and desired to be protected by Letters Patent of the United States is:

1. A mattress topper system, comprising:

a first foam layer of viscoelastic foam having a top surface and a bottom surface, wherein said top surface is shaped with one or more projections; and a second foam layer having a top surface and a bottom surface, wherein said second foam layer has a density less than said first foam layer, wherein said first and second foam layers are provided together to a consumer as separately unadhered layers that may be variously oriented one atop the other by the consumer as the mattress topper system over a separate bedding mattress.

2. The mattress topper system of claim 1, wherein the top surface of the second foam layer is shaped.

3. The mattress topper system of claim 2, wherein the shaped top surface of the first foam layer has one or more projections, and wherein the shaped top surface of the second foam layer has one or more depressions, and wherein each projection is nestable within at least one of the depressions.

4. The mattress topper system of claim 1, wherein the first foam layer has a foam density in the range of about 2 to about 6 pounds per cubic feet.

5. The mattress topper system of claim 1, wherein the second foam layer has a foam density in the range of about 1 to about 2 pounds per cubic feet.

6. The mattress topper system of claim 1, wherein the second foam layer is of viscoelastic elastic foam.

7. The mattress topper system of claim 1, further comprising consumer instructions for varying the support level by placing the first foam layer and the second foam layer in different orientations over a mattress.

8. The mattress topper system of claim 1, further comprising a package in which the first and second foam layers are packaged together for delivery to a consumer.

9. A method for varying cushioning support level of a mattress with a mattress topper system positioned atop the mattress, comprising:

providing a first foam layer of viscoelastic foam having a top surface and a bottom surface, wherein said top surface is shaped with one or more projections;

providing a second foam layer having a top surface and a bottom surface, wherein said second foam layer has a density less than said first foam layer and is separate and unadhered to said first foam layer so that it may be variously oriented above or below said first foam layer by a consumer; and instructing the consumer to vary cushioning support level by positioning said first foam layer and second foam layer over a top surface of the mattress by specifying alternate foam layer configurations to increase cushioning support level.

10. The method of claim 9, wherein the top surface of the second foam layer is shaped.

11. The method of claim 10, wherein the shaped top surface of the first foam layer has one or more projections, and wherein the shaped top surface of the second foam layer has one or more depressions, and wherein each projection is nestable within at least one of the depressions.

12. The method of claim 9, wherein the first foam layer has a foam density in the range of about 2 to about 6 pounds per cubic feet.

13. The method of claim 9, wherein the second foam layer has a foam density in the range of about 1 to about 2 pounds per cubic feet.

14. The method of claim 9, wherein the second foam layer is of viscoelastic foam.

* * * * *